US007624722B2

(12) United States Patent
Matthews

(10) Patent No.: US 7,624,722 B2
(45) Date of Patent: Dec. 1, 2009

(54) APPARATUS AND SYSTEM FOR EFFICIENTLY RECIRCULATING AN EXHAUST GAS IN A COMBUSTION ENGINE

(75) Inventor: Jeffrey A. Matthews, Columbus, IN (US)

(73) Assignee: Cummins, Inc, Columbus, IN (US)

( * ) Notice: Subject to any disclaimer, the term of this patent is extended or adjusted under 35 U.S.C. 154(b) by 0 days.

(21) Appl. No.: 11/967,942

(22) Filed: Dec. 31, 2007

(65) Prior Publication Data

US 2009/0165757 A1 Jul. 2, 2009

(51) Int. Cl.
*F02B 47/08* (2006.01)
*F02M 25/07* (2006.01)

(52) U.S. Cl. ..... 123/568.17

(58) Field of Classification Search ..... 123/568.17, 123/568.18

See application file for complete search history.

(56) References Cited

U.S. PATENT DOCUMENTS

| | | | | |
|---|---|---|---|---|
| 4,245,980 | A | 1/1981 | Reed et al. | |
| 5,832,732 | A | 11/1998 | Knopfel et al. | |
| 6,138,651 | A * | 10/2000 | Mori et al. | 123/568.17 |
| 6,272,851 | B1 * | 8/2001 | Mori et al. | 60/278 |
| 6,425,382 | B1 | 7/2002 | Marthaler et al. | |
| 6,427,671 | B1 | 8/2002 | Holze et al. | |
| 6,430,929 | B2 * | 8/2002 | Martin | 60/605.2 |
| 6,494,041 | B1 * | 12/2002 | Lebold | 60/605.2 |
| 6,779,974 | B2 * | 8/2004 | Chien | 415/206 |
| 6,810,867 | B2 * | 11/2004 | Schmid et al. | 123/568.17 |
| 6,948,483 | B2 * | 9/2005 | Veinotte | 123/568.18 |
| 7,028,680 | B2 | 4/2006 | Liu et al. | |
| 7,032,578 | B2 | 4/2006 | Liu et al. | |
| 7,140,357 | B2 | 11/2006 | Wei et al. | |
| 7,326,028 | B2 * | 2/2008 | Morando | 415/88 |
| 7,434,696 | B2 * | 10/2008 | Soto | 209/732 |
| 2004/0115049 | A1 * | 6/2004 | Chien | 415/206 |
| 2008/0104956 | A1 * | 5/2008 | Delvecchio et al. | 60/599 |

OTHER PUBLICATIONS

Munson, Bruce R., Donald F. Young and Theodore H. Okiishi. Fundamentals of Fluid Mechanics. Fifth. John Wiley & Sons, 2006, p. 445.*

PCT/US2008/088674 International Search Report and Written Opinion, Aug. 17, 2009.

* cited by examiner

*Primary Examiner*—Stephen K Cronin
*Assistant Examiner*—Anthony L Bacon
(74) *Attorney, Agent, or Firm*—Kunzler & McKenzie

(57) ABSTRACT

An apparatus and system are disclosed for efficiently recirculating an exhaust gas in a combustion engine. The apparatus includes an intake air conduit that accepts and promotes mixing of an intake air stream and an EGR stream. The intake air stream moves in the direction of the axis of the intake air conduit. The EGR stream enters the intake air conduit within a volute of decreasing area curled about the outside circumference of the intake air stream. The rate at which the volute encourages mixing of an EGR stream with an intake air stream is affected by the rate at which the volute's area decreases as the volute curls about the inside circumference of the intake air conduit, and by the angle of entry for the EGR stream as directed by the volute.

25 Claims, 6 Drawing Sheets

APPARATUS AND SYSTEM FOR EFFICIENTLY RECIRCULATING AN EXHAUST GAS IN A COMBUSTION ENGINE

BACKGROUND OF THE INVENTION

1. Field of the Invention

This invention relates to exhaust gas recirculation (EGR) systems on combustion engines, and more particularly relates to the process of mixing the EGR with intake air.

2. Description of the Related Art

Environmental concerns motivate emissions requirements for internal combustion engines throughout much of the world. Governmental agencies, such as the Environmental Protection Agency (EPA) in the United States, carefully monitor the emission quality of engines and set acceptable emission standards, to which all engines must comply. One important group of regulated emission components is the class of nitrogen oxides ($NO_x$) formed during engine combustion.

A system presently in use on many internal combustion engines to retard the formation of $NO_x$ is the exhaust gas recirculation (EGR) system. The EGR is mixed with air coming into the engine prior to the air entering the combustion chambers. The blending of EGR and intake air prior to combustion results in lower peak combustion temperatures due to lower concentrations of oxygen in the combustion chamber and the heat-sink effects of inert gas fractions, thus acting to prevent the formation of $NO_x$ during combustion. Furthermore, the EGR stream may pass through an EGR cooler prior to mixing with the incoming air, to further lower combustion temperatures and improve the power density of the engine. To ensure the engine runs properly and the emissions are effectively reduced, it is essential to thoroughly mix the EGR with the incoming air such that each cylinder receives an equal gas mixture.

Blending EGR with incoming air introduces competing design constraints. Designs which optimize the mixing of EGR and intake air often introduce significant pressure drop in the system and reduce the performance and efficiency of the engine. Designs which optimize the pressure drop while mixing EGR and intake air often result in poor mixing and inconsistent combustion mixtures reaching each cylinder. Additionally, the available packaging space for installing an EGR system on an engine is often low. Some EGR systems are introduced on engine-vehicle designs that originally did not include EGR, and serious costs are incurred for any extra space consumed by the EGR system. Even where EGR systems are designed into an original vehicle package, space constraints are often significant because increased space usage results in other tradeoffs that increase the cost of the engine and vehicle system.

Further, complicated pipe routing schemes are disfavored because such schemes introduce other constraints into the design of a vehicle system. For example, a pipe carrying EGR gas will typically be hot, and a complex routing scheme for the pipe may limit the places where electronics and other system components can be installed in the engine compartment of a vehicle. Additionally, a complex routing scheme for an EGR system reduces the generality of the engine-EGR design, thereby making an engine-EGR system less able to be dropped into various vehicles without significant redesign costs. Also, complex internal routing schemes with various slots and internal conduits introduce significant machining and manufacturing costs into the system. Further, complex routing schemes reduce transient response times due to large EGR path volumes, reduce transient performance due to inconsistent EGR compositions across the EGR path, and induce pressure drops due to long pipe lengths in the EGR path.

In the current art, several EGR mixing systems are typically used. In a first system, a series of 90-degree straight turns in the EGR system provide some assistance in mixing and help reduce the EGR path volume, but induce significant pressure loss. In a second system, a Venturi is used at the EGR-intake air connection point to reduce the pressure on the intake air side, but these systems provide poor mixing of EGR and intake air. In a third system, a vortex is induced in the intake air where EGR is mixed in. Variations of the third system may introduce added pressure drop through internal conduit flows, and introduce significant manufacturing costs into the system.

SUMMARY OF THE INVENTION

From the foregoing discussion, Applicant asserts that a need exists for an apparatus and system for efficiently recirculating exhaust gas in a combustion engine. Beneficially, such an apparatus and system would provide thorough mixing of EGR and intake air, with low pressure drop, in a small and simple physical package.

The present invention has been developed in response to the present state of the art, and in particular, in response to the problems and needs in the art that have not yet been fully solved by currently available methods. Accordingly, the present invention has been developed to provide an apparatus and system for efficiently recirculating an exhaust gas in a combustion engine that overcome many or all of the above-discussed shortcomings in the art.

An apparatus is disclosed to efficiently recirculate an exhaust gas stream for a combustion engine. The apparatus includes an intake air conduit receiving an intake air stream and an EGR stream, and directing a blended intake air and EGR stream to a combustion engine. The apparatus includes a volute having a reducing radius, width, and/or cross-section area to blend the EGR stream and intake air stream. In one embodiment, the volute has a large radius at the EGR conduit equal to the radius of the intake air conduit plus the diameter of the EGR conduit. In one embodiment, the volute has a small radius equal to the radius of the intake air conduit. The volute may engage the intake air conduit helically, perpendicularly, and/or at an acute angle with the direction of the intake air stream. The apparatus may further include multiple EGR streams intersecting the intake air conduit. The apparatus may further include an EGR path fluidly coupling the EGR valve to the volute, and the EGR path may be substantially arcuate. In one embodiment, the EGR path contains no turns greater than 60 degrees over any axial segment of the EGR path having a length equal to the diameter of the EGR conduit. In one embodiment, the EGR path is substantially straight.

A system is disclosed to efficiently recirculate an exhaust gas stream. The system includes an internal combustion engine receiving an intake air stream and producing an exhaust gas. The system includes an exhaust gas recirculation (EGR) stream that returns a portion of the exhaust gas to the intake air stream. The system further includes a volute that directs the EGR stream from an EGR conduit into the intake air conduit. In one embodiment, the system further includes a turbocharger, and a remainder of the exhaust gases pass through the turbocharger.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

It will be readily understood that the components of the present invention, as generally described and illustrated in the figures herein, may be arranged and designed in a wide variety of different configurations. Thus, the following more detailed description of the embodiments of the apparatus and system of the present invention, as presented in FIGS. 1 through 6, is not intended to limit the scope of the invention, as claimed, but is merely representative of selected embodiments of the invention.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

Furthermore, the described features, structures, or characteristics may be combined in any suitable manner in one or more embodiments. In the following description, numerous specific details are provided, such as examples of materials, fasteners, sizes, lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

Figure 1:
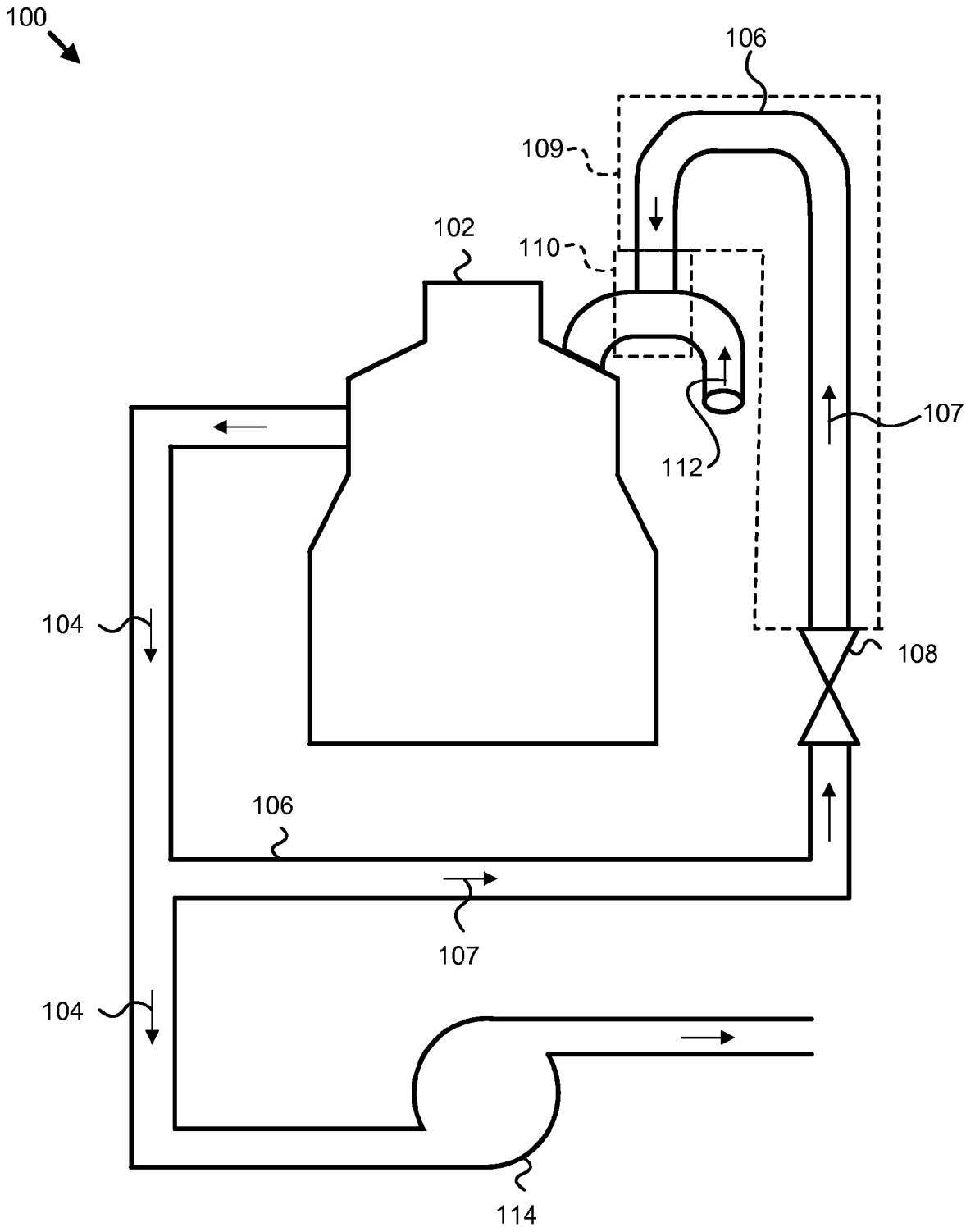
FIG. 1 is a schematic drawing depicting one embodiment of a system to efficiently recirculate an exhaust gas stream in accordance with the present invention.

FIG. 1 is an illustration depicting one embodiment of a system 100 to efficiently recirculate an exhaust gas stream in accordance with the present invention. The system 100 comprises a combustion engine 102, which may be any type of combustion engine 102 including a diesel engine 102. The combustion engine 102 produces an exhaust gas 104, a portion of which may be directed into an exhaust gas recirculation (EGR) conduit 106 as an EGR stream 107. The system 100 may further include a turbocharger 114, and a remainder of the exhaust gas 104 may pass through the turbocharger 114. While the embodiment of FIG. 1 illustrates the EGR stream 107 beginning the recirculation path upstream of the turbocharger 114 (a "high pressure" implementation), the EGR stream 107 may also begin the recirculation path from downstream of the turbocharger 114 (a "low pressure" implementation—not shown), or the EGR stream 107 may have any other routing understood in the art.

In one embodiment, the system 100 includes a mixer 110. The mixer 110 includes a volute, a portion of an intake air conduit, and an area where the volute engages the intake air conduit. The volute directs the EGR stream 107 from the EGR conduit 106 into the intake air conduit. The volute has a reducing radius, and a small radius equal to a radius of the intake air conduit.

The system 100 may include an EGR path 109 that fluidly couples the EGR valve 108 to the volute of the mixer 110. In one embodiment, the EGR path 109 is substantially arcuate, having a continuous curvature with no sharp turns. In one example, the EGR path 109 may turn less than 60 degrees in any given axial segment of the EGR path 109 with a length equal to the diameter of the EGR conduit 106. For example, if the EGR conduit 106 is 3 inches in diameter, the EGR path 109 may have no turns of 60 degrees or more within any 3 inch segment of the EGR path 109. The turns within the EGR path 109 may be measured by any description known within the art—for example by the mathematically calculated turns of a curve describing the geometric center of the EGR path 109. In one embodiment, the EGR path 109 is substantially straight (not shown) and carries the EGR stream 107 directly from the EGR valve 108 to the volute of the mixer 110.

The EGR valve 108 and the turbocharger 114 may be used to control the flow of exhaust gas 104 through the EGR conduit 106. The turbocharger 114 may affect the flow of exhaust gas 104 through the EGR conduit 106 by the amount of the backpressure generated by the turbocharger 114 in the system 100. The turbocharger 114 may manipulate backpressure in the exhaust gas 104 through adjustment of its geometry, as in a variable geometry turbo (VGT) 114, or by rerouting exhaust gas 104 through a wastegate around the turbocharger 114, as in a wastegate turbocharger 114.

Figure 2:
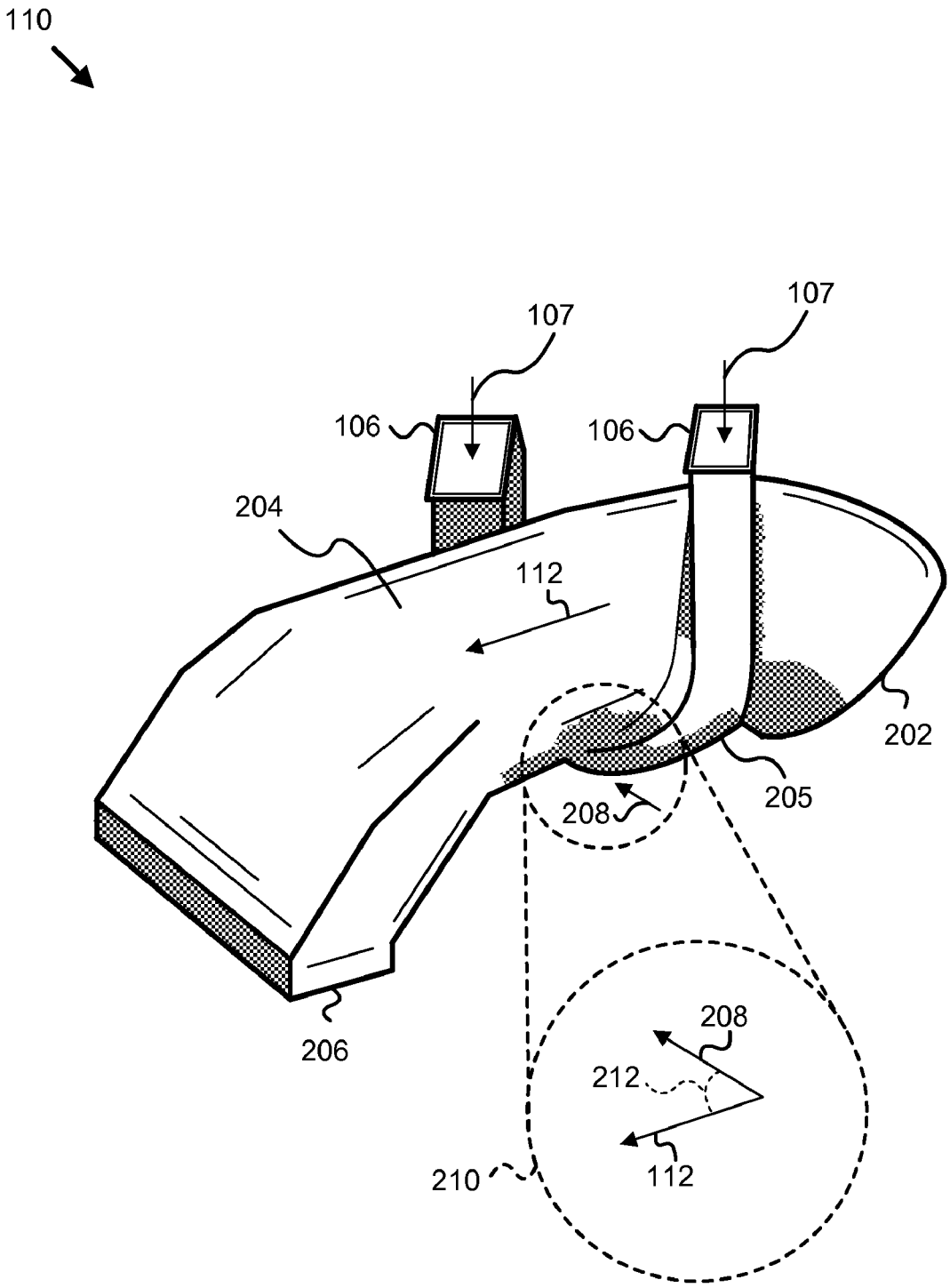
FIG. 2 is an illustration taken from a perspective view depicting one embodiment of a mixer to efficiently recirculate an exhaust gas stream in accordance with the present invention.

FIG. 2 is an illustration depicting one embodiment of the mixer 110 to efficiently recirculate a portion of the exhaust gas 104 in accordance with the present invention. The mixer 110 comprises an air inlet 202 configured to receive an intake air stream 112, and the EGR conduit 106 configured to direct a portion of the exhaust gas 104 into an intake air conduit 204 through a volute 205. In the embodiment of FIG. 2, the volute 205 engages the intake air conduit 204 at an acute angle with the flow direction of the intake air stream 112 in the intake air conduit 204. The detail 210 emphasizes the angle of the intake air stream 112 and the entry angle 208 of the volute 205 forming an acute angle 212 according to the mixer 110 illustrated in FIG. 2.

The EGR conduit 106 may comprise a single EGR conduit 106, or a plurality of EGR conduits 106, and the mixer 110 may thereby include multiple volutes 205. Each volute 205 may engage the intake air conduit 204 from opposite sides, the same side, and/or may be axially displaced along the length of the intake air conduit 204. Each EGR conduit 106 may approach the intake air conduit 204 vertically up or down, horizontally, and/or at some other intermediate position. The mixer 110 further includes an air outlet 206 that may be coupled to an intake manifold supplying the blended intake air stream 112 and exhaust gas 104 to the combustion engine 102.

Figure 3:
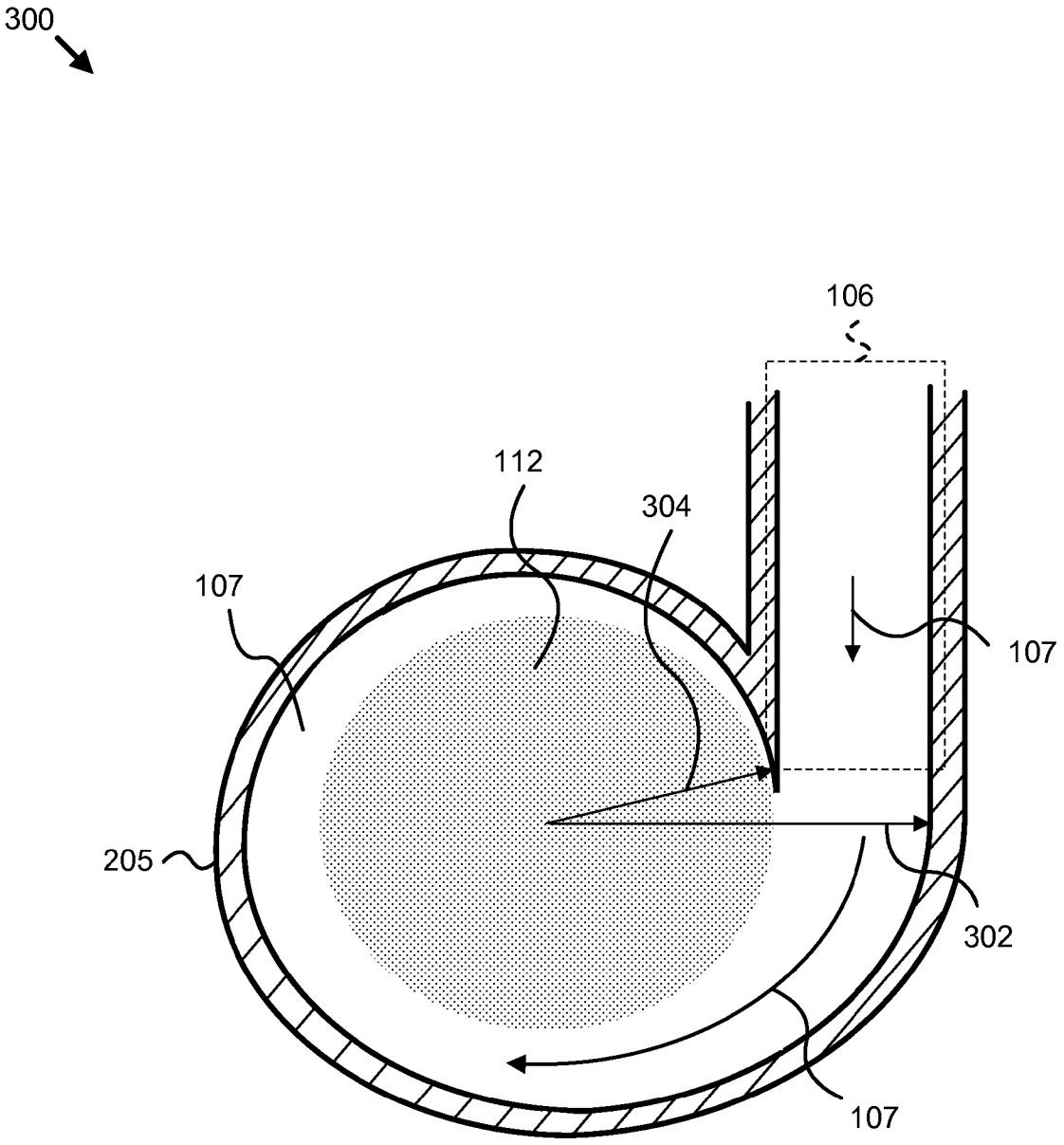
FIG. 3 is an illustration depicting one embodiment of a cross-section of a mixer to efficiently recirculate an exhaust gas stream in accordance with the present invention.

FIG. 3 is an illustration depicting one embodiment of a mixer cross-section 300 in accordance with the present invention. The mixer cross-section 300 comprises the structure of the intake air conduit 204, which contains the intake air stream 112 moving perpendicular to the plane of the illustration, and the EGR stream 107 curling around the inside circumference of the intake air conduit 204. In one embodiment, the EGR stream 107 may enter the intake air conduit 204 perpendicular to the intake air stream 112. In alternate embodiments, the EGR stream 107 may enter the intake air stream 112 at an acute angle 212 with the flow direction of the intake air stream 112. The acute angle 212 comprises some angle greater than an identical flow direction angle of 0 degrees and less than the perpendicular angle of 90 degrees. The illustration of FIG. 3 is a schematic illustration only, and does not necessarily show scale or other non-essential details. For example, where the volute 205 engages the intake air conduit 204 at an acute angle 208 less than 90 degrees, the volute large radius 302 and volute small radius 304 may not occur at the same point axially relative to the intake air conduit 204.

The mixer cross-section 300 further includes a volute 205 comprising a reducing radius, wherein the large volute radius 302 is equal to a diameter of the EGR conduit 106 plus the radius of the intake air conduit 204. The small volute radius 304 is equal to a radius of the intake air conduit 204. The rate at which the volute 205 decreases its radius affects the rate at which the EGR stream 107 becomes mixed with the intake air stream 112. One of skill in the art may determine for a particular application, using simple experimentation and the disclosures herein, the optimal rate for reducing the volute radius 302, 304 to minimize abrupt changes in the EGR stream 107 that may cause pressure drops in the system 100.

In one embodiment of the mixer cross-section 300, the volute 205 engages the intake air conduit 204 around about 360 degrees of the outside circumference of the intake air stream 112, as shown in FIG. 3. In an alternate embodiment, the volute engages the intake air conduit 204 around about 180 degrees of the outside circumference of the intake air conduit 204 (refer to FIG. 4). In other embodiments, the degree of curvature of the volute engaging the intake air conduit 204 may comprise angles between 180 degrees and 360 degrees, and may further comprise angles less than 180 degrees. In one embodiment, the volute 205 engages the intake air conduit 204 in a helical manner, and may comprise engage the intake air conduit 204 over angles greater than 360 degrees of the outside circumference of the intake air conduit 204. Generally, the mixing of the EGR stream 107 with the intake air stream 112 may be accomplished in about 180 degrees of curvature. One of skill in the art may determine for a particular application the necessary curvature to adequately mix the EGR stream 107 with the intake air stream 112 through simple testing of the blended streams (107, 112) and/or through modeling and analysis to determine whether the each cylinder is receiving a mixed intake gas stream while minimizing pressure drop.

Figure 4:
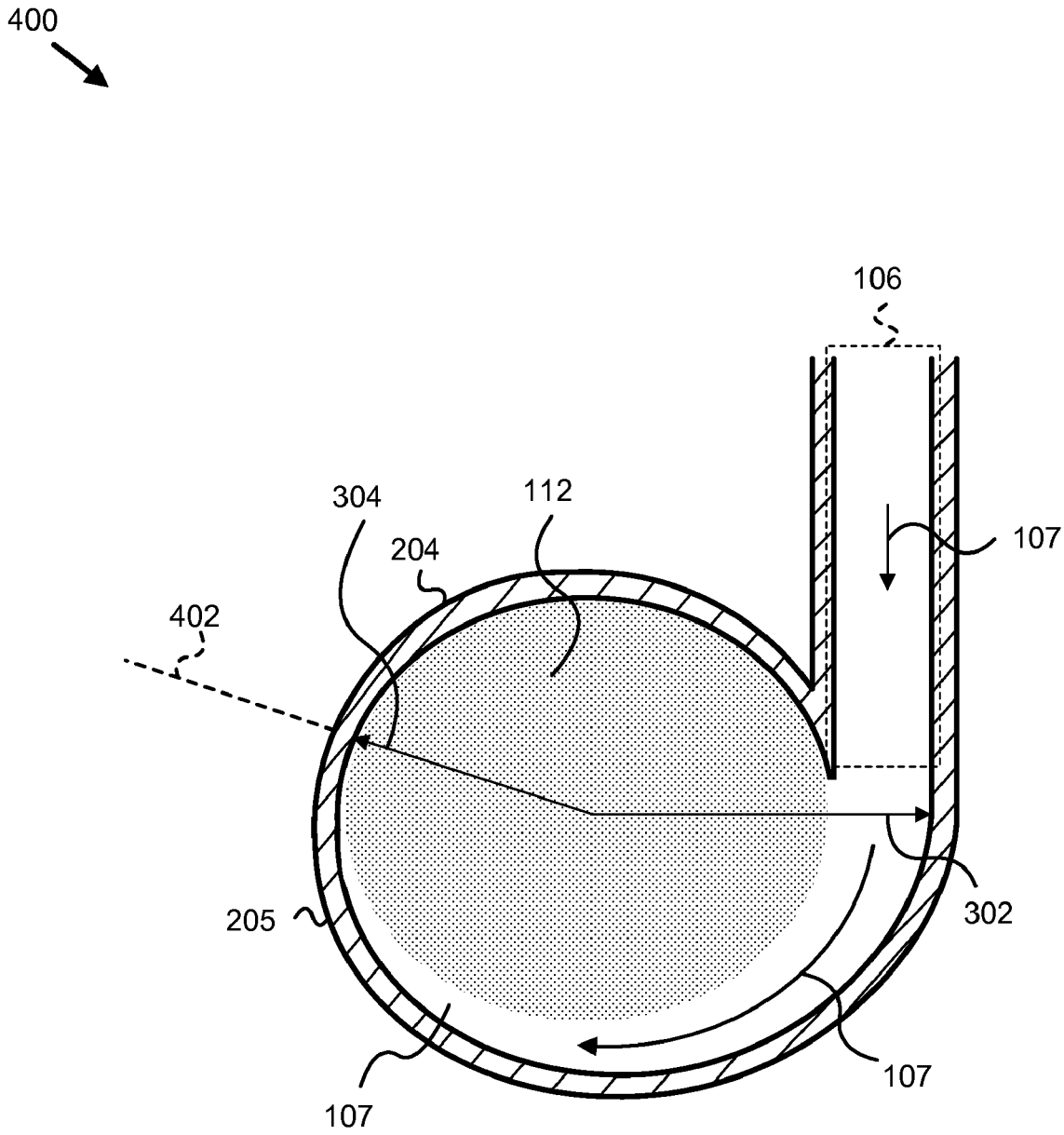
FIG. 4 is an illustration depicting one embodiment of a cross-section of a mixer to efficiently recirculate an exhaust gas stream in accordance with the present invention.

FIG. 4 is an illustration depicting one embodiment of a mixer cross-section 400 in accordance with the present invention. The mixer cross-section 400 comprises the structure of the intake air conduit 204, the EGR conduit 106, the intake air stream 112, and the EGR stream 107. The mixer cross-section 400 further includes the volute 205 comprising the large volute radius 302 and the small volute radius 304. FIG. 4 depicts the volute intersecting the intake air conduit 204 over about 180 degrees around the outside circumference of the intake air conduit 204. The outer wall depicted in the embodiment of FIG. 4 transitions 402 from volute 205 to intake air conduit 204 where the volute 205 has reduced to the small volute radius 304.

Figure 5:
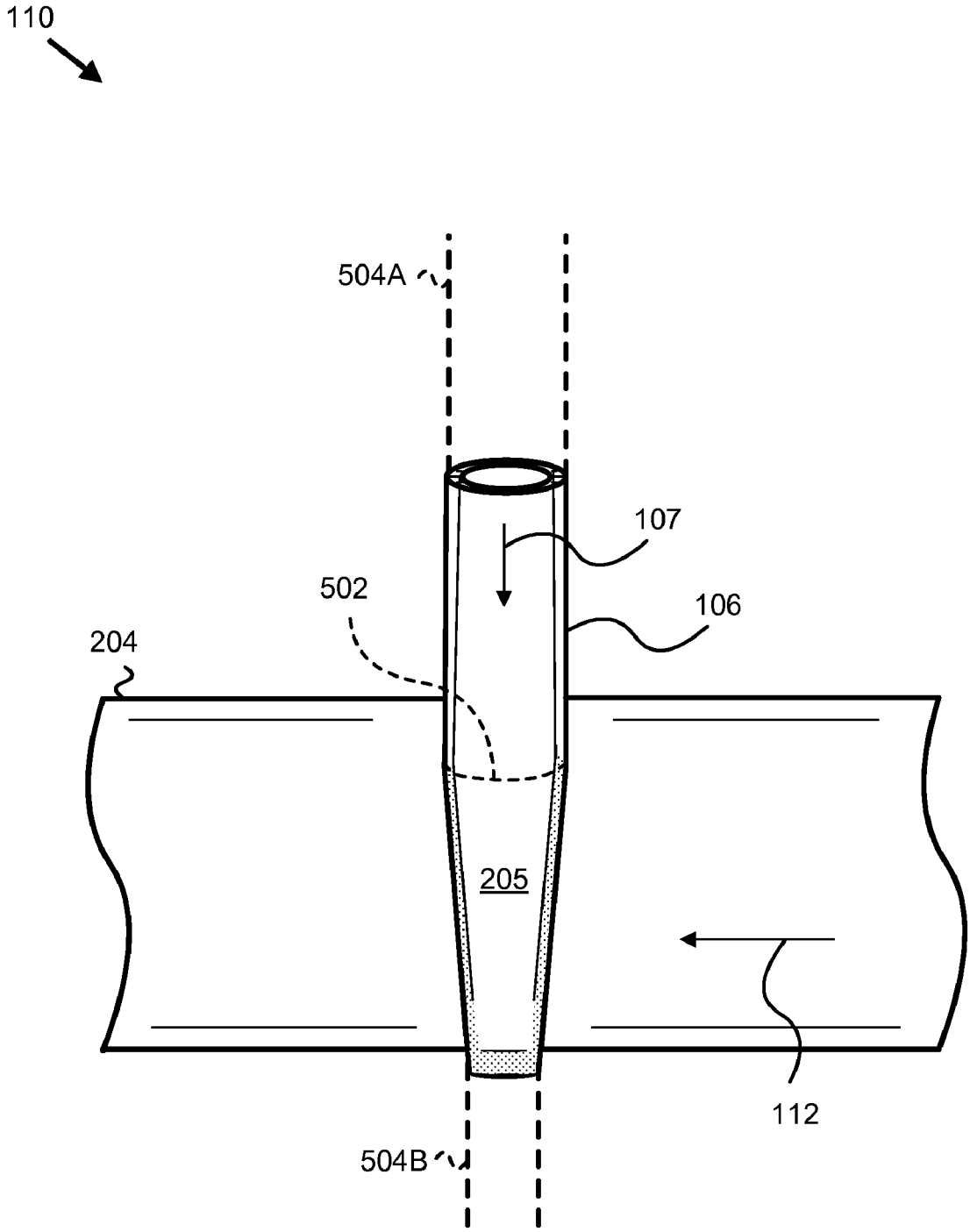
FIG. 5 is a side view of a mixer used to efficiently recirculate an exhaust gas stream in accordance with the present invention.

FIG. 5 is an illustration depicting one embodiment of a mixer 110 side-view to efficiently recirculate an exhaust gas 104 stream in accordance with the present invention. The mixer 110 shows the EGR conduit 106 conveying the EGR stream 107 to the volute 205, and the intake air conduit 204 receiving an intake air stream 112 and the EGR stream 107. FIG. 5 indicates an approximate region 502 where, in one embodiment, the large volute radius 302 begins. The large volute radius 302 may begin where the EGR conduit 106 begins to engage the intake air conduit 204. From the region 502 the volute 205 comprises a reducing width, with a large width 504A at the EGR conduit 106 and a small width 504B at the intake air conduit 204. The reducing width of the volute 205 acts to decrease the cross-sectional area of the volute 205, thereby smoothly increasing the velocity of the EGR stream 107 and the rate of mixing the EGR stream 107 with the intake air stream 112 while introducing minimal pressure drop into the mixer 110.

One of skill in the art may determine an optimal reduction of the reducing width for a particular application through simple experimentation (and/or through modeling and analysis) and the disclosures within. For example, a non-uniform intake air stream 112 composition after the mixer 300, 400 indicates that greater mixing is desirable, and the ratio of the large width 504A of the volute to the small width 504B of the volute could be increased to compensate. An increased pressure drop can be relieved with a lower ratio of the large width 504A of the volute to the small width 504B of the volute.

Figure 6:
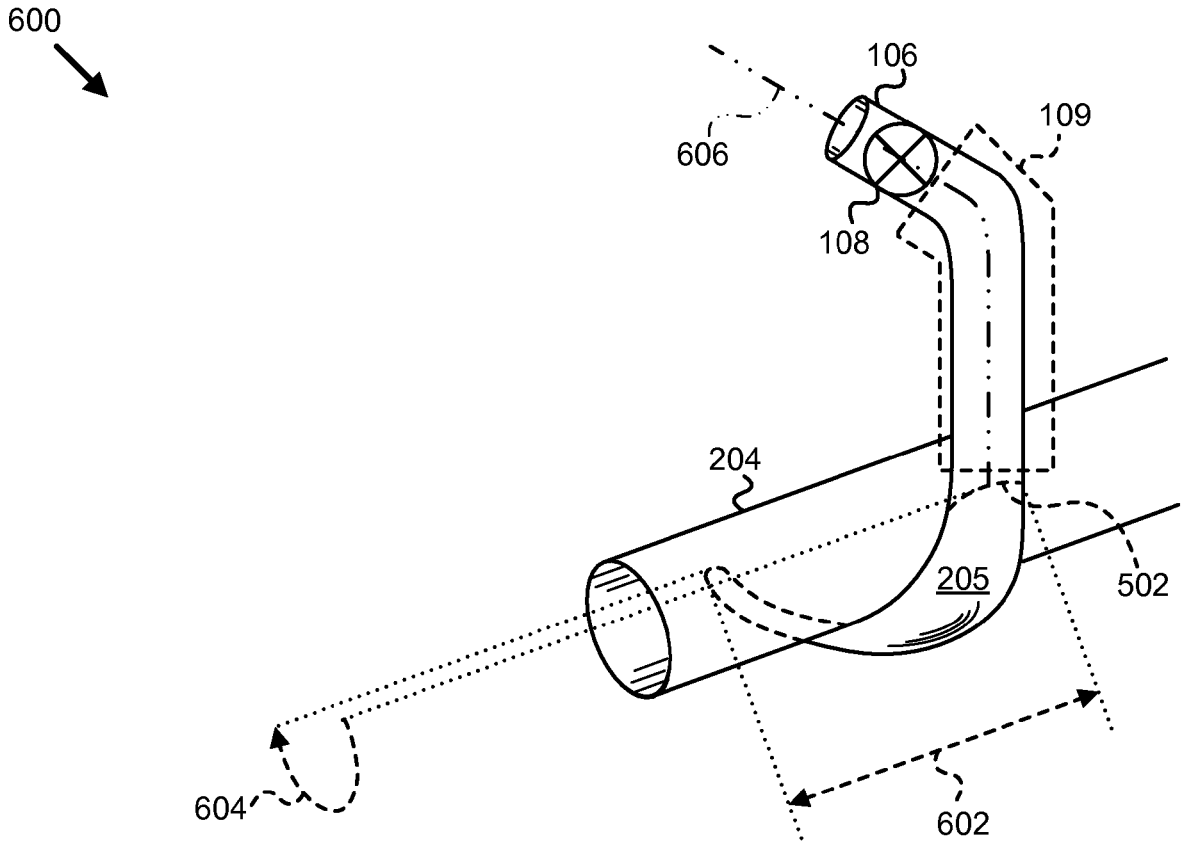
FIG. 6 is a schematic illustration depicting a volute engaging an air intake conduit in a helical manner.

FIG. 6 is a schematic illustration depicting an apparatus 600 comprising a volute 205 engaging an intake air conduit 204 in a helical manner. The volute engages the intake air conduit 204 over an axial distance 602 and around an angle 604 of the circumference of the intake air conduit 204. The apparatus 600 has an EGR path 109 fluidly connecting the EGR valve 108 to the volute 205. For example, the EGR path 109 in FIG. 6 ends at the approximate region 502 where the large volute radius 302 begins. The EGR path 109 is substantially arcuate. In one embodiment, a curve 606 describing the geometric center of the EGR path 109 turns less than 60 degrees through any axial section of the EGR path 109 having a length equal to a diameter of the EGR conduit 106. In one embodiment, a curve 606 describing the geometric center of the EGR path 109 turns less than 60 degrees through any 2-inch section of the EGR path.

In one embodiment, the volute intersects the intake air conduit 204 over an axial distance 602 such that a curve describing the geometric center of the volute 205 turns less than 60 degrees through any axial section of the volute 205 having a length equal to the diameter of the EGR conduit 106. In one embodiment, the volute 205 intersects the intake air conduit 204 over an axial distance 602 about equal to the radius of the intake air conduit 204. The volute may have a reducing radius 302, 304, a reducing width 504A, 504B, and or a reducing cross-sectional area.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus to efficiently recirculate an exhaust gas stream, the apparatus comprising:

an intake air conduit receiving an intake air stream and an exhaust gas recirculation (EGR) stream, and directing a blended intake air and EGR stream to a combustion engine; and a volute directing the EGR stream from an EGR conduit into the intake air conduit, the volute having a reducing radius and a small radius equal to a radius of the intake air conduit, the volute extending about a periphery of the intake air conduit in a helical manner;

wherein the helical volute intersects the intake air conduit over an axial distance of the intake air conduit at least about equal to a radius of the intake air conduit.

2. The apparatus of claim 1, further comprising an EGR path fluidly coupling an EGR valve and the volute, and wherein the EGR path is substantially straight.

3. The apparatus of claim 1, wherein the EGR stream is disposed within the EGR conduit, and wherein the volute comprises a large radius equal to the radius of the intake air conduit plus a diameter of the EGR conduit.

4. The apparatus of claim 1, wherein the volute comprises a reducing width, with a large width at the EGR conduit and a small width at the intake air conduit.

5. The apparatus of claim 1, wherein the volute engages the intake air conduit around at least about 180 degrees of a circumference of the intake air conduit.

6. The apparatus of claim 1, wherein the volute engages the intake air conduit around at least about 360 degrees of a circumference of the intake air conduit.

7. The apparatus of claim 1, further comprising a second EGR stream, and a second volute directing exhaust gas from a second EGR conduit into the intake air conduit, the second volute having a reducing radius and a small radius equal to the radius of the intake air conduit.

8. The apparatus of claim 7, wherein each volute is offset axially along the intake air conduit.

9. The apparatus of claim 7, wherein each volute directs one of the EGR streams into the intake air conduit on opposite sides of the intake air conduit.

10. An apparatus to efficiently recirculate an exhaust gas stream, the apparatus comprising:

an exhaust gas recirculation (EGR) path fluidly coupling an EGR valve and a volute, wherein the EGR path is substantially arcuate;

an intake air conduit receiving an intake air stream and an exhaust gas recirculation (EGR) stream, and directing a blended intake air and EGR stream to a combustion engine; and wherein the volute directs the EGR stream from an EGR conduit into the intake air conduit, the volute having a reducing cross-sectional area and an outlet through which the EGR stream enters the intake air stream, and wherein the volute outlet extends about an outer periphery of the intake air conduit in a helical manner along an axial length of the intake air conduit about equal to or greater than a radius of the intake air conduit; and wherein an axial length of the volute outlet is greater than the axial length of the intake air conduit along which the volute outlet extends.

11. The apparatus of claim 10, wherein the volute has at least one feature selected from the group consisting of a reducing radius and a reducing width.

12. The apparatus of claim 10, wherein a curve describing a geometric center of the EGR path turns less than 60 degrees through any axial section, having a length equal to a diameter of the EGR conduit, of the EGR path.

13. The apparatus of claim 10, wherein a curve describing a geometric center of the EGR path turns less than 60 degrees through any 2-inch section of the EGR path.

14. The apparatus of claim 10, wherein the volute engages the intake air conduit such that a curve describing a geometric center of the volute turns less than 60 degrees through any axial section, having a length equal to a diameter of the EGR conduit.

15. The apparatus of claim 10, wherein the volute intersects the intake air conduit over an axial distance of the intake air conduit about equal to a radius of the intake air conduit.

16. A system to efficiently recirculate an exhaust gas stream, the system comprising:

an internal combustion engine receiving an intake air stream disposed within an intake air conduit, and producing an exhaust gas;

an exhaust gas recirculation (EGR) stream that returns a portion of the exhaust gas to the intake air stream, the EGR stream being contained by a single EGR conduit; and at least two volutes in exhaust receiving communication with the EGR stream flowing through the single EGR conduit, the volutes directing the EGR stream from an the EGR conduit into the intake air conduit, each of the at least two volutes having a reducing radius and a small radius equal to a radius of the intake air conduit;

each of the at least two volutes extends about a periphery of the intake air conduit in a helical manner along an axial length of the intake air conduit about equal to or greater than a radius of the intake air conduit, a first of the at least two helical volutes extending counterclockwise about the periphery of the intake air conduit and a second of the at least two helical volutes extending clockwise about the periphery of the intake air conduit.

17. The system of claim 16, further comprising a turbocharger, wherein a remainder of the exhaust gas passes through the turbocharger.

18. The system of claim 16, wherein the EGR stream is disposed within the EGR conduit, and wherein the volute comprises a large radius equal to the radius of the intake air conduit plus a diameter of the EGR conduit.

19. The system of claim 18, wherein the volute comprises a reducing width, with a large width at the EGR conduit and a small width at the intake air conduit.

20. The system of claim 16, wherein the volute engages the intake air conduit at a perpendicular angle.

21. The system of claim 16, wherein the volute engages the intake air conduit at an acute angle with a flow direction of the intake air stream in the intake air conduit.

22. The system of claim 16, further comprising a second EGR stream and a mixer, wherein the mixer comprises the first volute and a second volute having a reducing radius, with a small radius equal to the radius of the intake air conduit.

23. The system of claim 22, wherein each volute is offset some distance axially along the intake air conduit.

24. The system of claim 16, wherein the volute engages the intake air conduit around at least about 360 degrees of a circumference of the intake air conduit.

25. The system of claim 16, wherein the volute engages the intake air conduit around at least about 180 degrees of a circumference of the intake air conduit.

* * * * *